United States Patent [19]

Gronlund et al.

[11] Patent Number: 4,934,174

[45] Date of Patent: Jun. 19, 1990

[54] SHEET METAL BENDING TOOL

[76] Inventors: R. David Gronlund; Dawn Gronlund, both of 6262 N. Fork Rd., Deming, Wash. 98244

[21] Appl. No.: 187,966

[22] Filed: Apr. 29, 1988

[51] Int. Cl.[5] ..... B21D 1/12

[52] U.S. Cl. ..... 72/458; 72/705; 254/131

[58] Field of Search ..... 72/476, 477, 479, 705, 72/458, 457; 254/25, 131; 7/166

[56] References Cited

U.S. PATENT DOCUMENTS

| | | | |
|---|---|---|---|
| 425,526 | 4/1890 | Seymour | 254/25 |
| 840,580 | 1/1907 | McMillan | 254/131 |
| 897,293 | 9/1908 | Korpi | 254/25 |
| 927,653 | 7/1909 | Heckman | 72/479 |
| 1,030,660 | 6/1912 | Hunt | 254/131 |
| 1,344,562 | 6/1920 | Probasco | 72/705 |
| 1,479,741 | 1/1924 | Reitz | 72/458 |
| 1,515,089 | 11/1924 | Boyer | 254/25 |
| 1,581,119 | 4/1926 | Herring | 72/705 |
| 1,616,653 | 2/1927 | Frasier et al. | 72/705 |
| 1,754,994 | 4/1930 | Ferguson | 72/479 |
| 1,879,583 | 9/1932 | Stowell | 72/705 |
| 2,330,023 | 9/1943 | Balousek | 29/270 |
| 2,457,231 | 12/1948 | Henderson | 254/25 |
| 4,120,256 | 10/1978 | Semler | 72/705 |
| 4,716,610 | 1/1988 | Therkildsen et al. | 7/166 |

FOREIGN PATENT DOCUMENTS

| | | | |
|---|---|---|---|
| 2455545 | 5/1976 | Fed. Rep. of Germany | 72/479 |

OTHER PUBLICATIONS

Mo-Clamp, "Update from a complete line of autobody tools and accessories; Pull-It with Mo-Clamp"; Jan. 1989; pp. 1, 12B, 24.

*Primary Examiner*—Robert L. Spruill

*Attorney, Agent, or Firm*—Allegretti & Witcoff, Ltd.

[57] ABSTRACT

A sheet metal bending tool is disclosed uniquely adapted for bending and repairing automotive sheet metal parts. The tool includes at least a shank and a hook end portion designed to facilitate holding and bending of sheet metal edges in a variety of applications. In a preferred embodiment, the tool also includes a "V" shaped inner surface specially adapted to grip metal pieces. Alternate constructions of the tool may include a useful ring-end portion or a second hook end portion to increase the range of applications for the tool.

8 Claims, 1 Drawing Sheet

SHEET METAL BENDING TOOL

BACKGROUND OF THE INVENTION

The present invention relates to the automotive repair art. More particularly, the invention relates to a tool useful for bending sheet metal in automotive body repair. The tool of the present invention is designed in such a way as to permit facile bending of sheet metal edges without damage to the body of the automobile.

In the past, a variety of hand tools has been utilized in automotive body repair for the purpose of bending sheet metal edges. A commonly used tool has been the well-known channel lock pliers which, while effective to bend the metal edges, causes detrimental denting and scratching of the metal surfaces. Another known means of bending sheet metal edges has involved the use of a hammer and dolly. Drawbacks of this method include overbending, flattening and distortion of the metal edges necessitating the use of plastic fillers or other cosmetic remedies to repair the resulting damage to the auto body. Other hand tools have been developed for specific metal bending applications, but none of these tools exhibits the advantageous features of the present invention.

SUMMARY OF THE INVENTION

The invention presently disclosed comprises a sheet metal bending tool including at least a shank and a hook end portion. The entire tool is made from a suitable grade of steel. The shank is formed, preferably of square or rectangular cross-section, to be approximately 10 millimeters thick and at least 60 millimeters in length. The shank is essentially straight, but preferably tapers slightly near the neck of the hook end portion.

The hook end portion of the tool comprises neck, lever and tip elements. The neck element is an extension of the shank, tapered to a thickness of approximately 2 millimeters. The neck is essentially straight, although a bend of up to about 120 degrees may be added near the shank to improve ease of use.

The lever element joins the end of the neck element opposite the shank to the tip element and the said lever extends away from the shank in a plane approximately parallel to the shank. In a preferred embodiment, the lever element includes essentially a "V" shape, formed by the inner faces of the neck element and the tip element, useful for gripping sharp metal edges. Alternatively, the inside edge between the neck and the tip may be formed as a smooth, rounded surface. The lever element of the hook end portion constitutes an extension useful for prying.

The tip element extends essentially parallel to the plane of the neck element at a distance of approximately 2.5 millimeters therefrom. The lever element and the tip element are each approximately 2 millimeters thick and 10 millimeters in width and the tip element preferably tapers from the lever element to a thickness of less than 2 millimeters and a width of less than 10 millimeters, except at the extreme end of the tip, which is preferably folded back upon itself or otherwise formed to have a thickness greater than 2 millimeters. The tip element is formed such that the distance from the inner apex of the "V" shape or rounded surface in the lever element to the far end of the tip element is between approximately 5.0 and 10.5 millimeters.

The dimensions of the entire tool may be scaled proportionally larger or smaller to accommodate different metal bending applications. For example, a larger version of the tool is useful for bending automobile bumpers and heavier metal.

Optionally, a second hook end portion may be added at the opposite end of the shank. The second hook end portion, if included, is preferably scaled proportionally either larger or smaller than the first hook end portion to permit use in different applications. In the most preferred embodiment, the neck of the second hook end portion includes a bend of 90 degrees from the shank, although other bends of from 0 to 120 degrees are also useful to increase the range of applications of the tool.

Alternatively, a useful ring-end portion may be provided at the shank and opposite the hook end portion. Such a ring-end is formed as a loop in a plane parallel to the arms of the hook end portion.

In any version of the tool of the present invention, a suitably sized hole may be provided through the shank through which a pin may be inserted to permit additional leverage in using the tool.

DETAILED DESCRIPTION OF THE DRAWING

Figure 1:
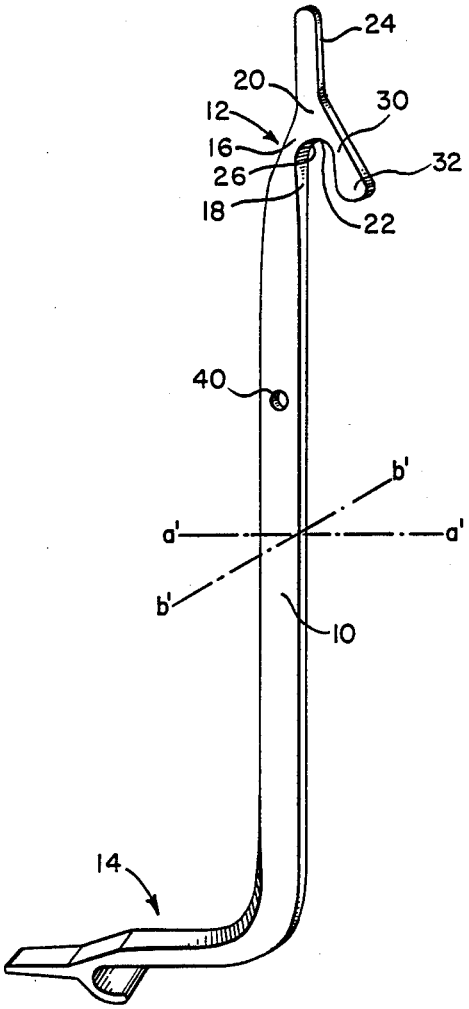
FIG. 1 is an angle view of a preferred embodiment of the invention, illustrating the shank and first and second hook end portions of the device as well as the optional hole.

A preferred embodiment of the present invention is disclosed in the following description of FIG. 1:

A shank 10, preferably of square or rectangular cross section, is formed from a suitable grade of steel to be approximately 10 millimeters thick (as measured along the axis a'—a' in FIG. 1) and at least 60 millimeters long. The shank 10 is provided with a first hook end 12 and a second hook end 14 and is essentially straight or, optionally, provided with a slight bend.

The neck 16 of the device, preferably formed from the same stock as the shank 10, is a narrowed portion having a neck face 18 across the width (as measured along the axis b'—b' in FIG. 1) of the neck 16 forming an inner surface. The neck 16 is the same width as the shank or slightly wider and narrows in thickness from approximately 10 millimeters adjacent the shank 10 to approximately 2 millimeters adjacent the lever 20. The neck face 18 is preferably smooth, or may be provided with a roughened or serrated surface.

Lever 20 is also preferably formed from the same piece of metal as the shank 10 and neck 16, but may be fabricated from a separate piece of stock and joined to the neck by welding or other suitable means. The lever comprises an inverted "Y" shaped section of essentially uniform thickness bent or formed to define an inner surface 22 and a lever arm 24. The inner surface 22 may be smooth and rounded, as shown in FIG. 1 or, preferably, formed to provide a "V" shape adapted to better grip metal edges. The lever is constructed such that the lever arm 24 extends outward through a length of approximately 10 to 15 millimeters in a plane parallel to that of the neck face 18, displaced approximately 3 millimeters from that plane. The inner surface 22 is preferably provided with serration 19 or teeth (not shown) to facilitate gripping of the piece on which the tool is used. If included, the "V" shaped section is formed such that the distance between the inner apex 26 of the inner surface 22 and the far end of the tip 30 is approximately 10 millimeters. The tip element 30 extends along the outward arm of the "Y" shaped section in a plane perpendicular to that of the neck face 18 at a distance of approximately 3.5 millimeters from that plane. The extreme end 32 of the tip 30 is rolled back upon itself or curved to an essentially oval cross section to provide a rounded end to protect the metal surface upon which the tool is used.

Optionally, a hole 40 may be provided through the shank 10, perpendicular to its axis, of suitable size to receive a pin (not shown) which may be used as an aid in grasping and twisting the tool.

Figure 2:
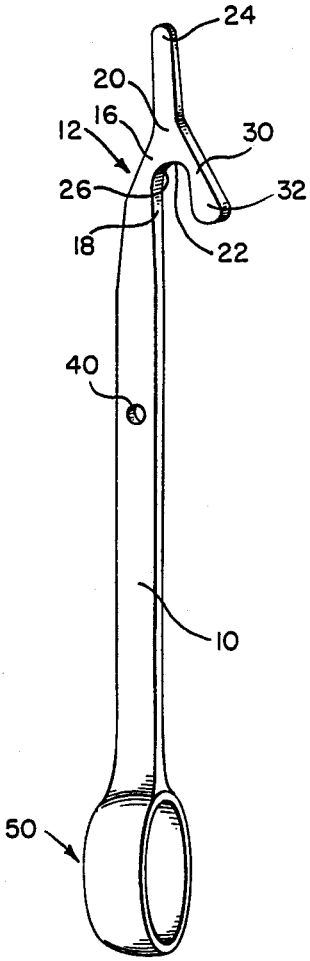
FIG. 2 is an angle view of an alternate ring-end version of the invention.

Referring now to FIG. 2, an alternate construction of the tool of the present invention is disclosed. In this embodiment, a ring-end portion 50 is located at the end of the shank opposite the first hook end 12. The ring-end portion 50 comprises a ring of the same composition and approximate thickness as the shank 10 and may be formed from the same piece of stock or joined by welding or other means. The ring-end portion 50 is preferably displaced in a plane parallel to the plane of the lever lever arm 24.

A preferred embodiment of the present invention is now described. Those skilled in the art will note that changes may be made in the device as described without departing from the spirit of the invention. The following claims conclude the specification:

We claim:

1. An improved sheet metal bending tool of the type useful in automobile body repair comprising a steel shank and a hook end portion, said shank comprising a suitable grade of steel formed in square or rectangular cross-section approximately 10 millimeters thick and at least 60 millimeters in length and having a taper at the end nearest the hook end portion, said hook end portion comprising neck, lever and tip elements;

said neck comprising an extension of the shank approximately 10 millimeters in width and 2 millimeters thick;

said lever joined to the neck opposite the shank such that the hook end portion comprises a "Y" shaped extension of the shank in a plane approximately parallel to the shank such that the plane of the tip element extends essentially parallel to the plane of the neck element, and the tip element is spaced at a distance of approximately 2.5 millimeters from the neck element;

said "Y" shaped extension defining an inner surface within the arms of the "Y";

said lever being approximately 10 millimeters in width and 2 millimeters thick, with a length of approximately 10 to 15 millimeters;

said tip element joined to the lever arm opposite the neck and shaped such that the distance from the apex of the lever element to the extreme end of the tip is approximately 10 millimeters;

said tip element being approximately 10 millimeters in width and 2 millimeters thick throughout a substantial part of its length;

in which the inner surface of the "Y" contains serration or teeth.

2. The improved sheet metal bending tool of claim 1 further including a hole through the shank, perpendicular to its axis.

3. The improved sheet metal bending tool of claim 1 further comprising a second hook end portion at the end of the shank opposite the first hook end portion.

4. The improved sheet metal bending tool of claim 1 further comprising a ring-end portion at the end of the shank opposite the hook-end portion.

5. An improved sheet metal bending tool of the type useful in automobile body repair comprising a steel shank and a hook end portion, said shank comprising a suitable grade of steel formed in square or rectangular cross-section approximately 10 millimeters thick and at least 60 millimeters in length and having a taper at the end nearest the hook end portion, said hook end portion comprising neck, lever and tip elements;

said neck comprising an extension of the shank approximately 10 millimeters in width and 2 millimeters thick;

said lever joined to the neck opposite the shank such that the hook end portion comprises a "Y" shaped extension of the shank in a plane approximately parallel to the shank such that the plane of the tip element extends essentially parallel to the plane of the neck element and the tip element is spaced at a distance of approximately 2.5 millimeters from the neck element;

said "Y" shaped extension defining an inner surface within the arms of the "Y";

said lever being approximately 10 millimeters in width and 2 millimeters thick, with a length of approximately 10 to 15 millimeters;

said tip element joined to the lever arm opposite the neck and shaped such that the distance from the apex of the lever element to the extreme end of the tip is approximately 10 millimeters;

said tip element being approximately 10 millimeters in width and 2 millimeters thick throughout a substantial part of its length;

further comprising a ring-end portion at the end of the shank opposite the hook-end portion.

6. The improved sheet metal bending tool of claim 5 further including a hole through the shank, perpendicular to its axis.

7. An improved sheet metal bending tool of the type useful in automobile body repair comprising a steel shank and a hook end portion, said shank comprising a suitable grade of steel formed in square or rectangular cross-section approximately 10 millimeters thick and at least 60 millimeters in length and having a taper at the end nearest the hook end portion, said hook end portion comprising neck, lever and tip elements;

said neck comprising an extension of the shank approximately 10 millimeters in width and 2 millimeters thick;

said lever joined to the neck opposite the shank such that the hook end portion comprises a "Y" shaped extension of the shank in a plane approximately parallel to the shank such that the plane of the tip element extends essentially parallel to the plane of the neck element and the tip element is spaced at a distance of approximately 2.5 millimeters from the neck element;

said "Y" shaped extension defining an inner surface within the arms of the "Y";

said lever being approximately 10 millimeters in width and 2 millimeters thick, with a length of approximately 10 to 15 millimeters;

said tip element joined to the lever arm opposite the neck and shaped such that the distance from the apex of the lever element to the extreme end of the tip is approximately 10 millimeters;

said tip element being approximately 10 millimeters in width and 2 millimeters thick throughout a substantial part of its length;

further including a hole through the shank portion, perpendicular to its axis; and, still further comprising a ring-end portion at the end of the shank opposite the hook-end portion.

8. The improved sheet metal bending tool of claim 7, in which the inner surfaces of the neck and lever elements contain serration or teeth.

* * * * *